US007481898B2

(12) United States Patent
Wayte et al.

(10) Patent No.: US 7,481,898 B2
(45) Date of Patent: Jan. 27, 2009

(54) METHOD FOR FABRICATING A THICK TI64 ALLOY ARTICLE TO HAVE A HIGHER SURFACE YIELD AND TENSILE STRENGTHS AND A LOWER CENTERLINE YIELD AND TENSILE STRENGTHS

(75) Inventors: Peter Wayte, Maineville, OH (US); Ming Cheng Li, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 506 days.

(21) Appl. No.: 10/692,985

(22) Filed: Oct. 24, 2003

(65) Prior Publication Data

US 2005/0087272 A1 Apr. 28, 2005

(51) Int. Cl.
*C22F 1/18* (2006.01)

(52) U.S. Cl. ..... 148/671

(58) Field of Classification Search ..... None
See application file for complete search history.

(56) References Cited

U.S. PATENT DOCUMENTS

| | | | | |
|---|---|---|---|---|
| 3,901,743 | A | 8/1975 | Sprague et al. | |
| 4,098,623 | A | 7/1978 | Ibaraki et al. | |
| 4,563,239 | A * | 1/1986 | Adinolfi et al. | 216/91 |
| 5,118,363 | A * | 6/1992 | Chakrabarti et al. | 148/671 |
| 5,219,521 | A | 6/1993 | Adams et al. | |
| 5,399,212 | A | 3/1995 | Chakrabarti et al. | |
| 6,370,956 | B1 * | 4/2002 | Bewlay et al. | 73/599 |
| 2001/0048019 | A1 * | 12/2001 | Beier et al. | 228/193 |
| 2004/0089380 | A1 * | 5/2004 | Woodfield | 148/671 |

FOREIGN PATENT DOCUMENTS

EP 0181713 10/1985

(Continued)

OTHER PUBLICATIONS

Titanium Metals Corporation: Properties and Processing of TIMETAL 6-4, Dec. 2001, http://www.timet.com/timetal6-4frame.html.*

(Continued)

*Primary Examiner*—John P. Sheehan
*Assistant Examiner*—Jessee R. Roe
(74) *Attorney, Agent, or Firm*—McNees Wallace & Nurick, LLC

(57) ABSTRACT

A Ti-6Al-4V-0.2O (Ti64) forged article is fabricated by forging a workpiece to make a forged gas turbine engine component having a thick portion thereof with a section thickness greater than 2¼ inches. The forged article is heat treated by solution heat treating at a temperature of from about 50° F. to about 75° F. below the beta-transus temperature of the alloy, thereafter water quenching the gas turbine engine component to room temperature, and thereafter aging the gas turbine engine component at a temperature of from about 900° F. to about 1000° F. The resulting machined gas turbine engine component has a 0.2 percent yield strength of from about 120 ksi to about 140 ksi at its centerline, and a 0.2 percent yield strength of from about 160 ksi to about 175 ksi at a location about ½ inch below a surface thereof.

20 Claims, 2 Drawing Sheets

FOREIGN PATENT DOCUMENTS

| | | |
|---|---|---|
| EP | 0852164 | 9/1995 |
| EP | 0921207 | 11/1998 |
| EP | 1486576 | 6/2004 |

OTHER PUBLICATIONS

AMS-T-9047, Titanium and Titanium Alloy, Bars (Rolled or Forged) and Reforging Stock, Aircraft Quality, May 2003, Aerospace Material Specification, pp. 1-22.*

Davis et al, ASM Handbook, 1995, ASM International, vol. 4, pp. 913-919.*

Titanium Metals Corporation: Properties and Processing of TIMETAL: 6-4, Dec. 2001, http://ww.timet.com/timetal6-4frame.html.*

Davis et al., The ASM Handbook, Aug. 1991, vol. 4, pp. 913-923.*

* cited by examiner

METHOD FOR FABRICATING A THICK TI64 ALLOY ARTICLE TO HAVE A HIGHER SURFACE YIELD AND TENSILE STRENGTHS AND A LOWER CENTERLINE YIELD AND TENSILE STRENGTHS

This invention relates to the fabrication of thick articles of Ti64 alloy and, more particularly, to the fabrication of such articles with a controllable difference in the near-surface and centerline mechanical properties.

BACKGROUND OF THE INVENTION

Ti64 alloy, having a nominal composition in weight percent of 6 percent aluminum, 4 percent vanadium, 0.2 percent oxygen, balance titanium and impurities, is one of the most widely used titanium-base alloys. The Ti64 alloy is an alpha-beta titanium alloy that may be heat treated to have a range of properties that are useful in aerospace applications. Ti64 alloy is used in both thin-section and thick-section applications, and heat treated according to the section thickness. In an example of interest, Ti64 alloy is used to make thick-section forged parts of aircraft gas turbine engines, such as compressor disks, fan disks, and engine mounts, which have at least some locations with a section thickness of greater than 2¼ inches. The present approach is concerned with such thick-section articles.

In the current best practice to achieve the optimal combination of strength and other properties, after forging the thick-section Ti64 articles are typically heat treated at a temperature of 1750° F., followed by an anneal heat treatment at 1300° F. The result is a 0.2 percent yield strength throughout the article of from about 120 ksi ("ksi" is an abbreviation for "thousands of pounds per square inch") to about 140 ksi. This strength has been satisfactory for many thick-section applications.

To achieve higher yield strengths in the article, a more heavily alloyed, heavier forgeable alloy such as Ti17, having a nominal composition in weight percent of 5 percent aluminum, 4 percent molybdenum, 4 percent chromium, 2 percent tin, and 2 percent zirconium, is used. The Ti17 alloy uses a higher percentage of expensive alloying elements than does Ti64 alloy, with the result that a large, thick-section part made of Ti17 alloy is significantly more expensive than the same part made of Ti64 alloy.

There is a need for an improved approach to achieving excellent mechanical properties in forgeable titanium alloys. The present invention fulfills this need, and further provides related advantages.

SUMMARY OF THE INVENTION

The present invention provides a fabrication approach for thick-section parts made of Ti64 alloy. This approach achieves significantly improved properties where needed for the surface and near-surface regions of the thick-section parts made of this well-proven alloy. The ability to use an established alloy is an important advantage, as new procedures for melting, casting, and forging a new alloy are not required. Nor is it necessary to employ a more heavily alloyed composition such as Ti17.

A method for fabricating a forged titanium-alloy article comprises the steps of providing a workpiece made of a titanium alloy having a nominal composition in weight percent of 6 percent aluminum, 4 percent vanadium, 0.2 percent oxygen, balance titanium and impurities. The titanium alloy has a beta-transus temperature. The workpiece is thereafter forged to make a forged gas turbine engine component, such as a compressor disk, a fan disk, or a gas turbine engine mount. The forged article, which is preferably a gas turbine engine component, has a thick portion thereof with a section thickness greater than 2¼ inches.

The forged gas turbine engine component is thereafter heat treated by solution heat treating the forged gas turbine engine component at a temperature of from about 50° F. to about 75° F. below the beta-transus temperature, preferably for a time of from about 45 minutes to about 75 minutes. The gas turbine engine component is thereafter quenched to room temperature and thereafter aged for a minimum of 4 hours at a temperature between 900° F. and 1000° F. Desirably, the water quenching is initiated within about 20 seconds of completing the step of solution heat treating by removal of the component from the solution-treating furnace.

The forged gas turbine engine component is thereafter final machined. The final machining is typically performed both to remove the high-oxygen, less ductile alpha-case at the surface and to produce the final features of the gas turbine engine component.

In the usual practice, the forged gas turbine engine component is ultrasonically inspected in a rough-machined shape generated by rough machining the forging either prior to the solution heat treat or following all heat treatment. The ultrasonic inspection is performed either after the step of forging the workpiece and before the step of heat treating, or after the step of heat treating and before the step of final machining. Where the forged gas turbine engine component is a compressor or fan disk, and where the ultrasonic inspection is performed after the step of forging and before the step of heat treating, after the ultrasonic inspection rough slots may be machined into the periphery of the disk so that the subsequent heat treatment imparts the improved properties to the bottoms of the slots.

The thick section of the gas turbine engine component given this heat treatment procedure desirably has a 0.2 percent yield strength of from about 120 ksi to about 140 ksi at its centerline, and a higher 0.2 percent yield strength of from about 160 ksi to about 175 ksi at a location nearer a surface thereof. The higher yield strength region of about 160-175 ksi typically extends downwardly from the surface of the gas turbine engine component to a depth of from about ¾ to about 1 inch below the surface. There is additionally an increase in the tensile strength associated with the increased yield strength. At greater depths, the gas turbine engine component has the lower yield strength range of about 120-140 ksi.

In the work leading to the present invention, it was recognized that the near-surface regions of the thick gas turbine engine components are subjected to the highest stresses in service at locations about ½ inch below the final machined finished part surface. The present heat treatment procedure produces the highest yield strength and tensile strength material in the near surface regions of the thick article, where the tensile strength is most needed. The near surface regions thus perform mechanically as though they are made of a stronger material than the conventionally heat treated Ti64 material that is found toward the center regions of the thick article. The result is that the Ti64 material may be used in applications for which it would otherwise not have sufficient mechanical properties.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
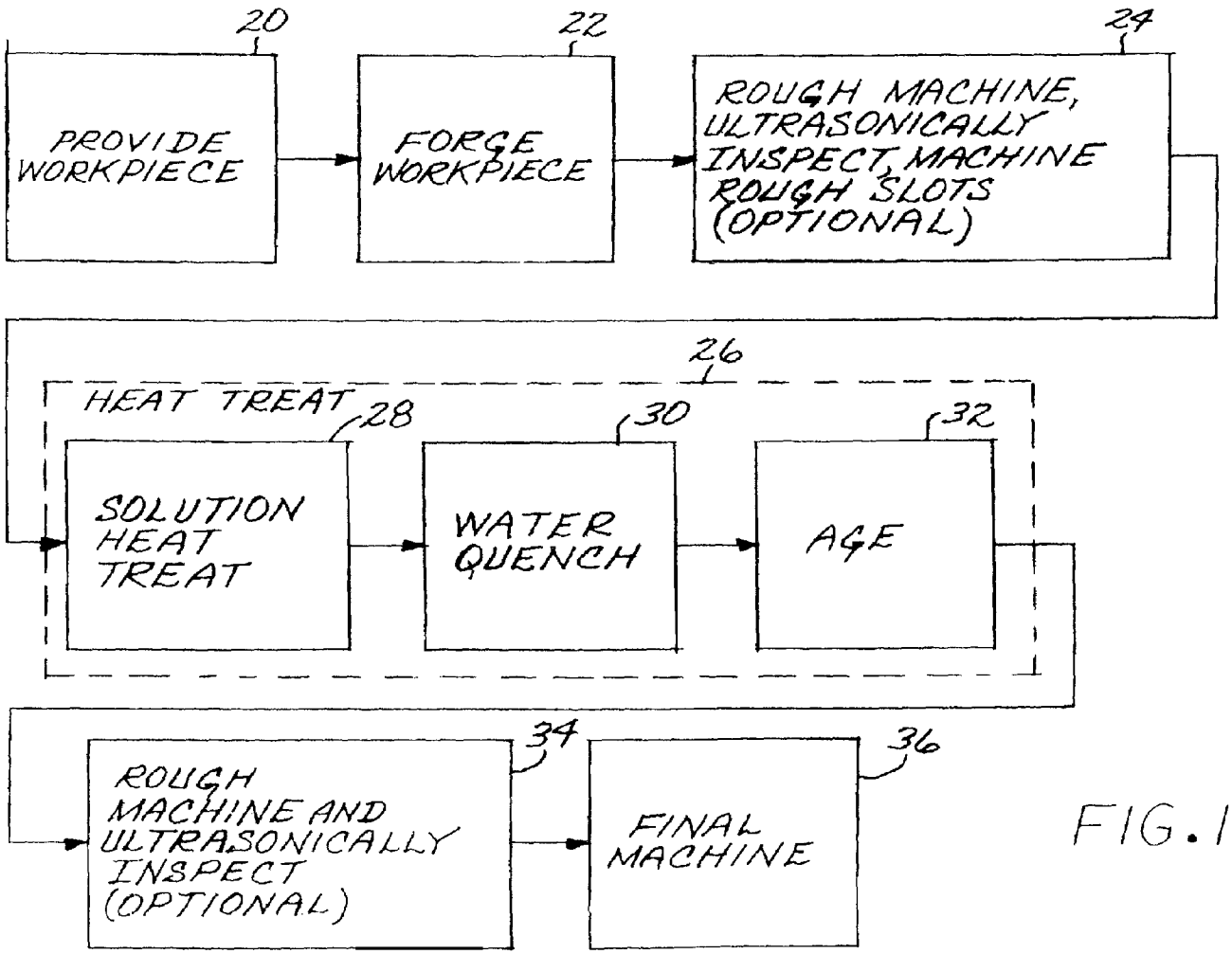
FIG. 1 is a block flow diagram of a preferred embodiment of an approach for fabricating a forged titanium-alloy article.

FIG. 1 depicts in block diagram form a method for practicing a preferred approach for fabricating a forged titanium-alloy article. The method comprises the steps of providing a workpiece made of the titanium alloy, known as Ti64, having a nominal composition in weight percent of 6 percent aluminum, 4 percent vanadium, 0.2 percent oxygen, balance titanium and impurities, step 20. The Ti64 titanium alloy has a nominal beta-transus temperature of about 1820° F., although the beta-transus temperature varies with compositional variations from the nominal composition. In the preferred practice, the titanium alloy is melted and cast as an ingot, and converted by hot working to billet form. The billet is sliced transversely to form a workpiece termed a "mult".

Figure 2:
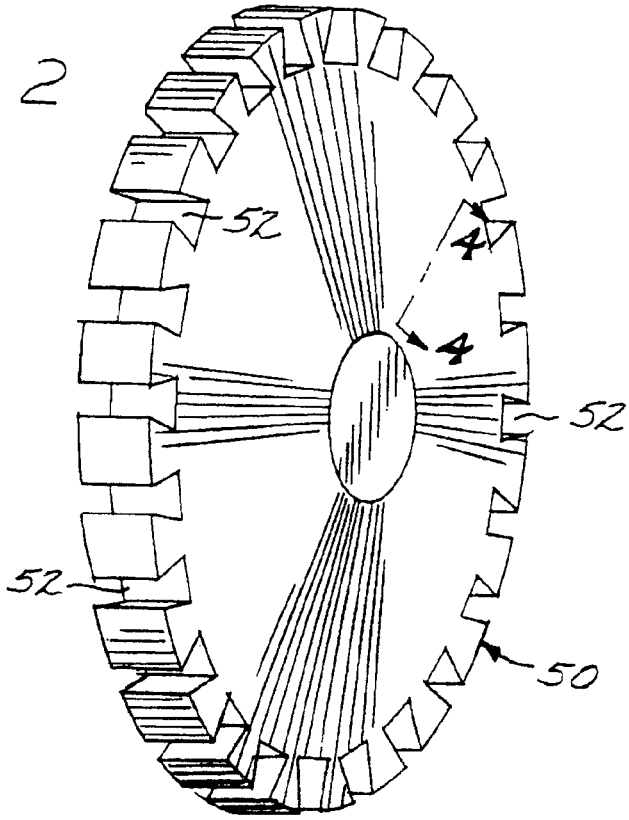
FIG. 2 is a perspective view of a disk such as a compressor disk or a fan disk.
Figure 3:
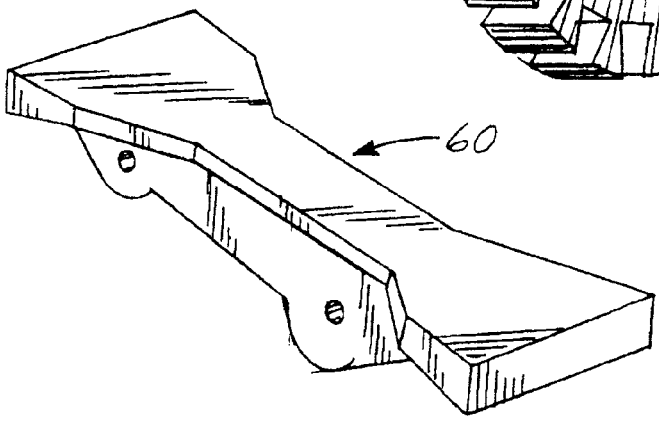
FIG. 3 is a perspective view of a gas turbine engine mount.

In the preferred embodiment, the workpiece is forged to make a forged gas turbine engine component, step 22. (As used herein, "forged gas turbine engine component" includes both the final forged gas turbine engine component and also the precursors of the final article resulting from the forging step 22.) The forged gas turbine engine component has a thick portion thereof with a section thickness greater than 2¼ inches, termed a "thick-section" article. The entire forged gas turbine engine component need not have a section thickness greater than 2¼ inches, as long as at least some portion of the forged gas turbine engine component has the section thickness of greater than 2¼ inches. FIGS. 2-3 illustrate the final form (after all of the processing is complete) of two forged gas turbine engine components of particular interest, a compressor or fan disk 50 (FIG. 2) and a gas turbine engine mount 60 (FIG. 3).

The step 20 of providing the workpiece and the step 22 of forging the workpiece are performed by conventional techniques known in the art.

After the forging step 22, the forged gas turbine engine component is optionally ultrasonically inspected, step 24, by known techniques. In the usual practice where step 24 is performed, the forged gas turbine engine component is first annealed at 1300° F. for 1 hour and cooled to room temperature. It is then rough machined into a rough-machined shape with at least some flat sides to facilitate the ultrasonic inspection of step 24. The rough-machined shape is larger than the final machined shape of the article, so that at least some material may be machined away in the subsequent final-machining step. In the case where the forged gas turbine engine component is a compressor or fan disk, after the ultrasonic inspection is performed rough slots 52 may be machined into the periphery of the disk so that the subsequent heat treatment imparts the improved properties to the surface and near-surface regions near the bottoms of the slots.

The forged gas turbine engine component is heat treated, step 26. The heat treatment 26 includes three substeps, performed sequentially one after the other as illustrated. The first substep 28 is solution heat treating the forged gas turbine engine component at a solution-heat-treatment temperature of from about 50° F. to about 75° F. below the beta-transus temperature. The nominal beta-transus temperature for Ti64 alloy is about 1820° F., and the solution heat treating step 28 is performed at a temperature of from about 1770° F. to about 1745° F. for the nominal-composition Ti64 alloy. This solution-heat-treatment temperature range may be adjusted somewhat for variations in the exact composition of the Ti64 alloy being employed, as long as the solution-heat-treatment temperature is from about 50° F. to about 75° F. below the beta-transus temperature. The preferred time for solution heat treating of the forged gas turbine engine component is from about 45 minutes to about 75 minutes, most preferably about 60 minutes, at the solution heat treating temperature of from about 50° F. to about 75° F. below the beta-transus temperature. The solution heat treating 28 is preferably accomplished in air and in a furnace held at the solution heat treatment temperature.

The second substep of the heat treatment 26 is water quenching the gas turbine engine component to room temperature, step 30. The gas turbine engine component is transferred from the solution heat treating furnace to a water quench bath as quickly as possible at the conclusion of step 28. Desirably, the water quenching 30 is initiated within about 20 seconds of removing the gas turbine engine component from the solution-heat-treating furnace, which removal completes the solution heat treating step 28.

The third substep of the heat treatment 26 is aging the gas turbine engine component at a temperature of from about 900° F. to about 1000° F., step 32, after the step 30 is complete. The aging step 32 is preferably continued for a time of at least about 4 hours after all of the gas turbine engine component reaches the aging temperature. The aging heat treating 32 is preferably accomplished in air and in a furnace held at the aging heat treatment temperature.

After the heat treating step 26, the forged-and-heat-treated gas turbine engine component is optionally ultrasonically inspected, step 34, by known techniques. If the gas turbine engine component has not previously been rough machined in the manner discussed in relation to step 24, that rough machining is performed as part of step 34, before the ultrasonic inspection. Although steps 24 and 34 are each optional, it is desirable that at least one of them be performed.

The gas turbine engine component is thereafter final machined to the finished shape and dimensions, step 36. The final machining removes the high-oxygen, less ductile alpha-case on the surface of the forging, typically a thickness of about 0.020 inches of material, and also produces the final features of the gas turbine engine component, such as the final form of the dovetail slots 52 on the rim of the compressor or fan disk 50 of FIG. 2.

Figure 4:
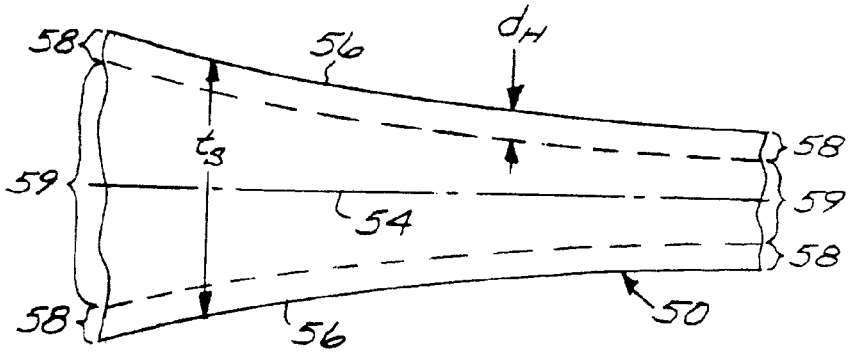
FIG. 4 is a schematic sectional view through the disk of FIG. 2, taken on line 4-4.

FIG. 4 is a schematic sectional view of the disk 50, illustrating the structure resulting from the present approach. There is a section centerline 54 and two surfaces 56 of the disk 50. The section has a local section thickness $t_S$ that may be constant or, as illustrated, variable. At least some portion of the section thickness $t_S$ is greater than 2¼ inches, so that the disk 50 may be considered a "thick" section. There is a hardened depth $d_H$ of a hardened zone 58 extending below each of the surfaces 56. The hardened depth $d_H$ typically extends from the surface 56 to a depth of from about ¾ inch to about 1 inch below the surface 56, the "near-surface" region. The 0.2 percent yield strength of the material in the hardened zone 58, such as at a depth of about ½ inch below the surface, is from about 160 ksi ("ksi" is a standard abbreviation for "thousands of pounds per square inch", so that 160 ksi is 160,000 pounds per square inch) to about 175 ksi in the hardened zone 58. The remaining central zone 59, which can have a variable thickness as illustrated, has a lower yield strength. The 0.2 percent yield strength is from about 120 ksi to about 140 ksi measured at the centerline 54.

This variation in yield strength is produced by the heat treatment of step 26 of FIG. 1. The different yield strengths within the two zones 58 and 59 is a desirable feature, so that the greatest yield strength is provided where it is needed during the service of the gas turbine engine component, near its surface.

It has been known in the art to heat treat thin pieces of Ti64 material, less than about 2 inches thick, by solution heat treating at a temperature of from about 50° F. to about 75° F. below the beta-transus temperature, thereafter water quenching to a temperature of less than about 850° F., and thereafter aging at a temperature of from about 900° F. to about 1000° F. However, the benefits could not be extended to thicknesses greater than about 2 inches. In the present approach, it is recognized that a harder zone near the surface of the article and a softer zone in the center of the article is beneficial to the resulting properties. This approach permits the Ti64 alloy to be used to higher performance levels, and avoids the need to utilize more-expensive alloys to make thick-section articles.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for fabricating a forged titanium-alloy article, comprising the steps of providing a workpiece made of an alpha-beta titanium alloy having a nominal composition in weight percent of 6 percent aluminum, 4 percent vanadium, 0.2 percent oxygen, balance titanium and impurities, wherein the titanium alloy has a beta-transus temperature; thereafter forging the workpiece to make a forged gas turbine engine component, wherein the forged gas turbine engine component has a thick portion thereof with a section thickness greater than 2¼ inches; thereafter rough machining the forged gas turbine engine component; thereafter heat treating the machined forged gas turbine engine component by the steps consisting essentially of solution heat treating the machined forged gas turbine engine component at a temperature of from about 50° F. to about 75° F. below the beta-transus temperature, thereafter water quenching the gas turbine engine component to room temperature, and thereafter aging the gas turbine engine component at a temperature of from about 900° F. to about 1000° F.; and thereafter final machining the forged gas turbine engine component.

2. The method of claim 1, wherein the step of providing the workpiece includes the steps of preparing a melt of the titanium alloy, thereafter casting the melt of the titanium alloy to form an ingot, thereafter converting the ingot to a billet by hot working, and thereafter cutting the billet transversely to form a mult that serves as the workpiece.

3. The method of claim 1, wherein the step of forging the workpiece includes the step of forging the workpiece to make the forged gas turbine engine component selected from the group consisting of a compressor disk, a fan disk, and a gas turbine engine mount.

4. The method of claim 1, wherein the step of forging the workpiece includes the step of forging the workpiece to make a forged compressor disk or a forged fan disk.

5. The method of claim 1, wherein the step of solution heat treating includes the step of solution heat treating the forged gas turbine engine component for a time of from about 45 minutes to about 75 minutes.

6. The method of claim 1, wherein the step of water quenching is initiated within about 20 seconds of completing the step of solution heat treating.

7. The method of claim 1, wherein the step of aging includes the step of aging the forged gas turbine engine component for a time of at least about 4 hours.

8. The method of claim 1, including an additional step, after the step of forging the workpiece and before the step of heat treating, of ultrasonically inspecting the forged gas turbine engine component.

9. The method of claim 1, including an additional step, after the step of forging the workpiece and before the step of final machining, of ultrasonically inspecting the forged gas turbine engine component.

10. The method of claim 1, wherein the step of final machining includes the step of removing the alpha-case at a surface of the gas turbine engine component.

11. A method for fabricating a forged titanium-alloy article comprising the steps of providing a workpiece made of an alpha-beta titanium alloy having a nominal composition in weight percent of 6 percent aluminum, 4 percent vanadium, 0.2 percent oxygen, balance titanium and impurities, wherein the titanium alloy has a beta-transus temperature; thereafter forging the workpiece to make a forged gas turbine engine component, wherein the forged gas turbine engine component has a thick portion thereof with a section thickness greater than 2¼ inches; thereafter rough machining the forged gas turbine engine component; thereafter heat treating the machined forged gas turbine engine component by the steps consisting essentially of solution heat treating the machined forged gas turbine engine component at a temperature of from about 50° F. to about 75° F. below the beta-transus temperature, thereafter water quenching the gas turbine engine component to room temperature, and thereafter aging the gas turbine engine component at a temperature of from about 900° F. to about 1000° F.; and thereafter final machining the gas turbine engine component, wherein the thick portion has a 0.2 percent yield strength of from about 120 ksi to about 140 ksi at its centerline, and a 0.2 percent yield strength of from about 160 ksi to about 175 ksi at a location about ½ inch below a surface thereof.

12. The method of claim 11, wherein the step of providing the workpiece includes the steps of preparing a melt of the titanium alloy, thereafter casting the melt of the titanium alloy to form an ingot, thereafter converting the ingot to a billet by hot working, and thereafter cutting the billet transversely to form a mult that serves as the workpiece.

13. The method of claim 11, wherein the step of forging the workpiece includes the step of forging the workpiece to make the forged gas turbine engine component selected from the group consisting of a compressor disk, a fan disk, and a gas turbine engine mount.

14. The method of claim 11, wherein the step of forging the workpiece includes the step of forging the workpiece to make a forged compressor disk or a forged fan disk.

15. The method of claim 11, wherein the step of solution heat treating includes the step of solution heat treating the forged gas turbine engine component for a time of from about 45 minutes to about 75 minutes.

16. The method of claim 11, wherein the step of water quenching is initiated within about 20 seconds of completing the step of solution heat treating.

17. The method of claim 11, wherein the step of aging includes the step of aging the forged gas turbine engine component for a time of at least about 4 hours.

18. The method of claim 10, including an additional step, after the step of forging the workpiece and before the step of heat treating, of ultrasonically inspecting the forged gas turbine engine component.

19. The method of claim 11, including an additional step, after the step of heat treating and before the step of final machining, of ultrasonically inspecting the forged gas turbine engine component.

20. The method of claim 11, wherein the step of final machining includes the step of removing the alpha-case at the surface of the gas turbine engine component.

* * * * *